US005618157A

United States Patent [19]

Pratt et al.

[11] Patent Number: 5,618,157

[45] Date of Patent: Apr. 8, 1997

[54] DETACHABLE COUPLER ASSEMBLY

[75] Inventors: Samuel S. Pratt, Bedford; Dan Shaffer, Duncansville; Tim A. Davis, Berlin; Ashley Heiple, Alum Bank, all of Pa.

[73] Assignee: Rockland, Inc., Bedford, Pa.

[21] Appl. No.: 433,648

[22] Filed: May 4, 1995

[51] Int. Cl.[6] ..... E02F 3/32

[52] U.S. Cl. ..... 414/723; 37/468; 294/88; 294/93

[58] Field of Search ..... 294/86.4, 86.41, 294/88, 90, 93, 119.1, 902; 901/30, 31, 41; 37/468; 414/723

[56] References Cited

U.S. PATENT DOCUMENTS

| | | | |
|---|---|---|---|
| 4,242,778 | 1/1981 | Kay | 901/30 |
| 4,913,617 | 4/1990 | Nicholson | 294/86.4 |
| 4,944,628 | 7/1990 | Huldén | 414/723 |
| 5,145,313 | 9/1992 | Weyer | 37/468 |
| 5,171,053 | 12/1992 | Rouleau | 294/90 |
| 5,242,202 | 9/1993 | Ettinger | 294/119.1 |
| 5,360,249 | 11/1994 | Monforte et al. | 294/86.4 |
| 5,465,513 | 11/1995 | Sonerud | 37/468 |

*Primary Examiner*—Dean Kramer
*Attorney, Agent, or Firm*—Lalos & Keegan

[57] ABSTRACT

An assembly for coupling an implement to an operating arm of a machine generally consisting of a first component including a base section fixedly mounted on a wall portion of the implement and an annular flange section disposed on an upper end of the base section, and a second component connectable to the operating arm, including a base section disposable in coupling relation with the first component, a pair of gripping members disposed on the base section and displacable into and out of gripping engagement with the annular flange section of the first component when the components are disposed in coupling relation and an actuator for selectively displacing the gripping members into and out gripping engagement with the annular flange section of the first component, each of the gripping members having a recess for receiving a segment of the annular flange section therein, having an end wall surface engagable with an annular end wall surface segment of the annular flange section, in gripping engagement, and upper and lower opposed wall surfaces for receiving the segment of the annular surface section therebetween.

7 Claims, 3 Drawing Sheets

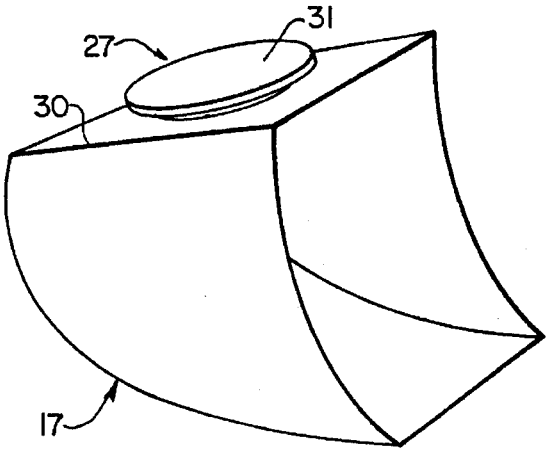
FIG. 3
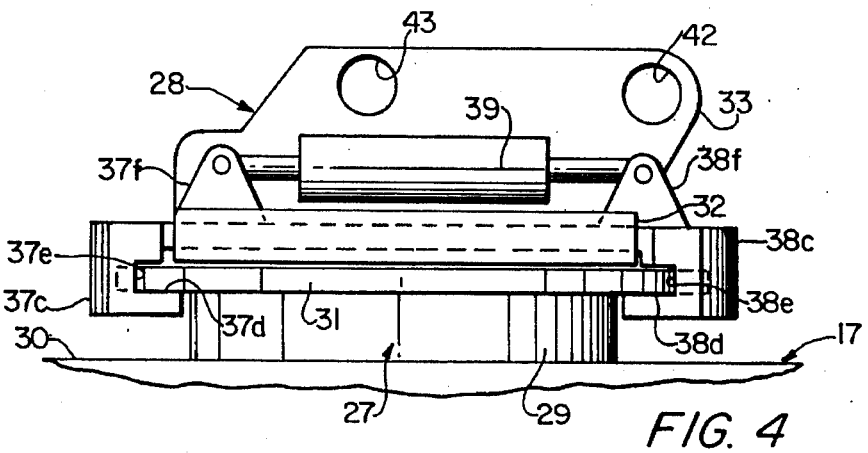
FIG. 4
FIG. 5
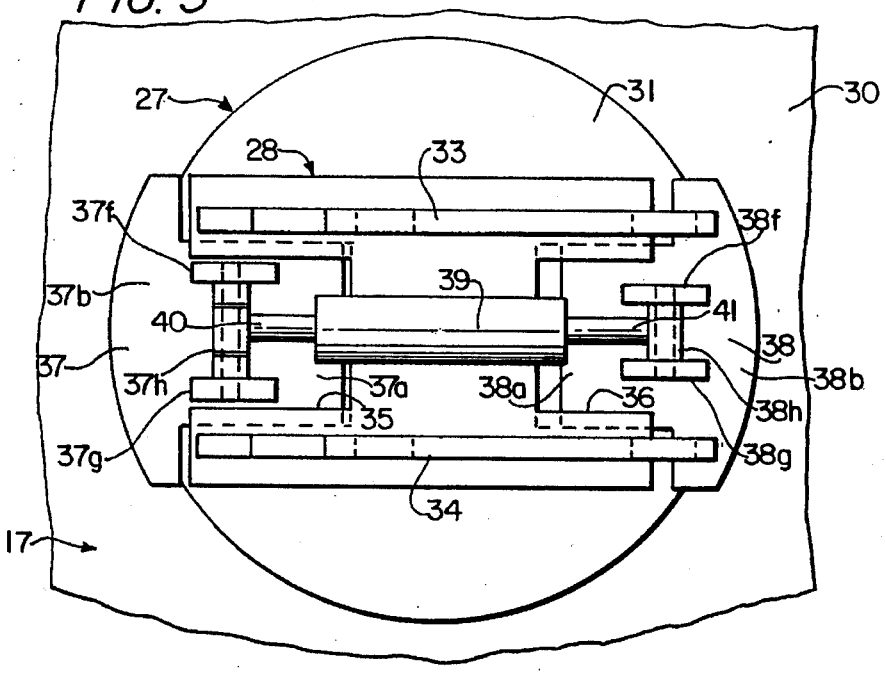

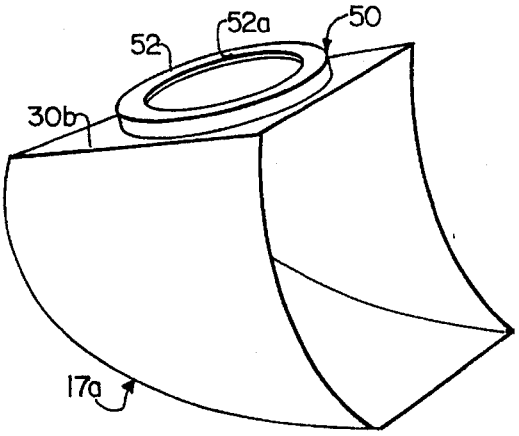
FIG. 6
FIG. 8
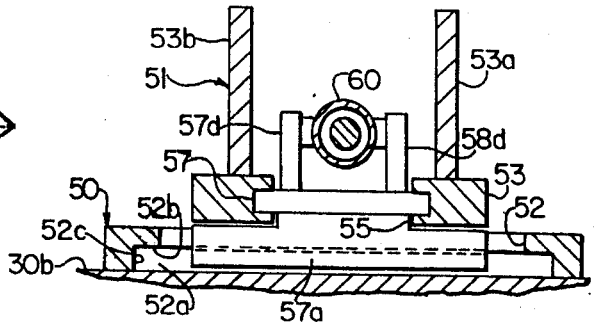
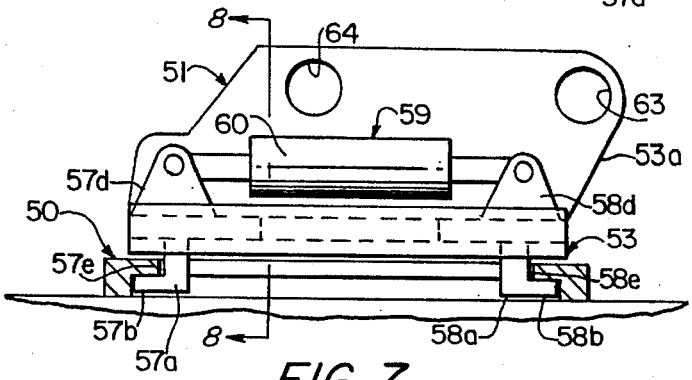
FIG. 7
FIG. 9
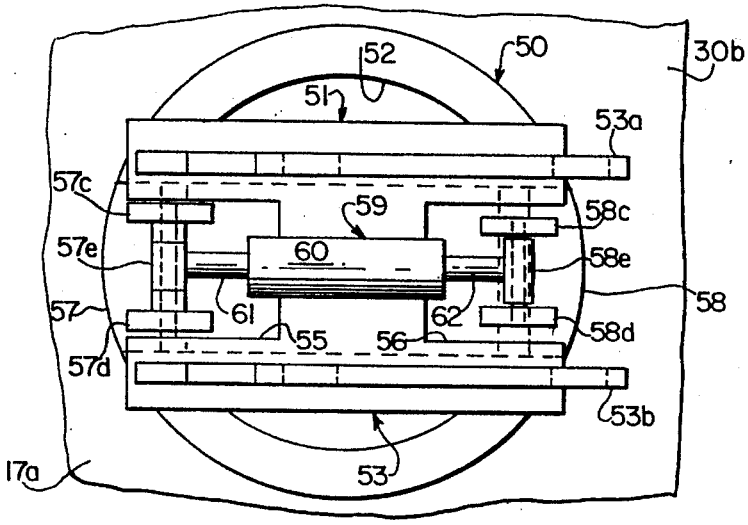

DETACHABLE COUPLER ASSEMBLY

This invention relates to an assembly for detachably coupling an implement to the operating arm of a machine in which the implement may be angularly displaced relative to the operating arm of the machine about a given axis, and more particularly to such an assembly which more effectively prevents a separation of the implement from the operating arm of the machine when the assembly is in a fully or partially coupled condition.

In the prior art, there has been developed a type of assembly for detachably coupling an implement to the operating arm of a machine which generally consists of a first component fixedly mounted on the implement, having an annular, beveled gripping surface, and a second component connectable to the operating arm of the machine, having a main body section disposable relative to the implement mounted component in coupling relation and a set of gripping members having arcuate, beveled contact surfaces adapted to engage the annular beveled gripping surface of the implement mounted component when the components are disposed in coupling relation and the gripping members are either retracted or extended.

Typically, the gripping members of such assemblies may be fully retracted or extended with the gripping surfaces thereof in fully gripping engagement with the contact surface of the implement mounted component, partially retracted or extended with the contact surfaces thereof, displaced from gripping engagement with the gripping surface of the implement mounted component but not sufficiently displaced therefrom to permit separation of the implement from the operating arm, thereby permitting the implement to be angularly displaced relative to the operating arm, and fully retracted or extended with the contact surfaces thereof, sufficiently displaced to permit the complete separation of the implement from the operating arm of the machine.

When such assemblies are in the partially uncoupled condition as described, there exists the possibility that in maneuvering the implement to angularly displace the implement relative to the operating arm, particularly when the implement is held above the ground, the implement inadvertingly may separate from the operating handle and shift or fall to the ground, risking injury to personnel and/or damage to property. It therefore has been found to be desirable to provide an assembly of the type described in which there is provided means for assuring against an inadvertent separation of the implement from the operating arm of the machine when the components are in a partially uncoupled condition with the implement still supported on the operating arm of the machine.

Accordingly, it is the principal object of the present invention to provide an improved assembly for detachably coupling an implement to the operating arm of a machine.

Another object of the present invention is to provide an improved assembly for detachably coupling an implement to the operating arm of a machine in which the implement may be angularly displaced relative to the operating arm of the about a given axis.

A further object of the present invention is to provide an improved assembly for detachably coupling an implement to the operating arm of a machine in which the implement may be partially uncoupled from the operating arm yet supported thereon, permitting the maneuvering of the operating arm to angularly displace the implement relative to the operating arm.

A still further object of the present invention is to provide an improved assembly for detachably coupling an implement to the operating arm of a machine in which the implement may be partially uncoupled from the operating arm yet supported thereon in which the implement is prevented from separating from the operating arm and shifting or falling.

Another object of the present invention is to provide an improved assembly for detachably coupling an implement to the operating arm of a machine which is simple in design, effective in performance and safe to operate.

Other objects and advantages of the present invention will become more apparent to those persons having ordinary skill in the art to which the present invention pertains from the following description taken in conjunction with the accompanying drawings wherein:

FIG. 3 is a perspective view of the implement shown in FIGS. 1 and 2, detached from the operating arm the machine;

FIG. 4 is an enlarged, side elevational view of the coupling assembly shown in FIGS. 1 and 2, having a portion thereof broken away;

FIG. 5 is a top plan view of the assembly shown in FIG. 4;

FIG. 6 is a perspective view of an implement connectable to the operating arm of the machine shown in FIG. 1 by means of another coupling assembly comprising another embodiment of the present invention;

FIG. 7 is a side elevational view of such other coupling assembly, having a portion thereof broken away;

FIG. 8 is a cross-sectional view taken along line 8—8 in FIG. 7; and FIG. 9 is a top plan view of the coupling assembly shown in FIG. 7.

Figure 1:
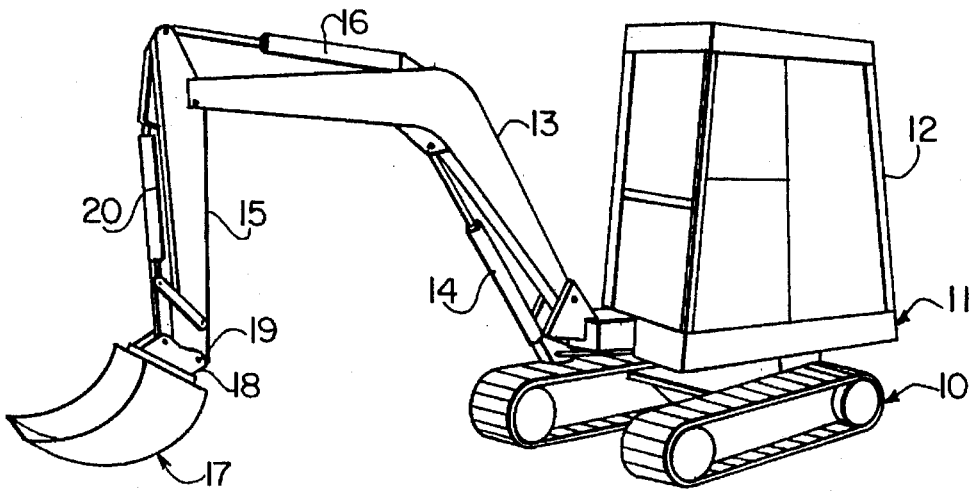
FIG. 1 is a perspective view of an excavating machine equipped with an implement coupling assembly embodying the present invention.
Figure 2:
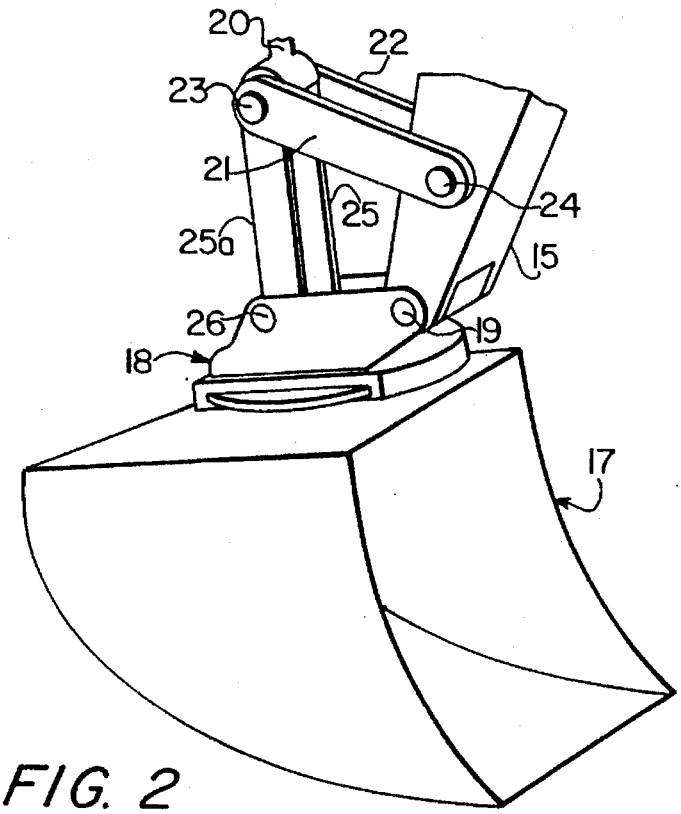
FIG. 2 is an enlarged perspective view of the lower end of the operating arm, coupler assembly and implement shown in FIG. 1, illustrating the implement displaced 180° relative to the position of the implement shown in FIG. 1.

Referring to FIGS. 1 and 2 of the drawings, there is illustrated an excavator machine generally consisting of a crawler unit 10, a main frame 11 mounted on the crawler unit for pivotal movement about a vertical axis and a cab structure 12 mounted on the main frame and housing an operator's station. Pivotally mounted on the front end of the main frame is a boom 13 which is adapted to be pivoted about a horizontal axis by means of a hydraulic cylinder assembly 14 operatively interconnecting the main frame and a set of brackets on the underside of the boom. An operating arm 15 is pivotally connected to the free end of the boom and is adapted to be pivoted about a horizontal axis relative to the boom by means of a hydraulic cylinder assembly 16 operatively interconnecting an upper end of the boom and an upper free end of the operating arm. A bucket 17 is connected to the lower end of the operating arm by means of a coupler assembly 18. As best shown in FIG. 2, coupling 18 is pivotally connected to the operating arm by means of a connecting pin 19 and the coupling assembly and the bucket may be caused to pivot as a unit relative to the operating arm about the axis of connecting pin 19 by means of a hydraulic cylinder assembly 20. As best shown in FIG. 1, the cylinder end of assembly 20 is pivotally connected to an upper end of the operating arm, and the rod end thereof is connected to a pair of support links 21 and 22 by means of a connecting pin 23. The support links are pivotally connected to a lower portion of the operating arm by means of a connecting pin 24, and connecting pin 23 is connected to a forward end of the coupling assembly by means of a pair actuating links 25 and 25*a* and a connecting pin 26. It will be appreciated that by operating certain controls at the operator's station, the entire front end assembly of the machine may be swung about the swing axis of the main frame of the machine, lowered, the operating arm may be pivoted relative to the boom and the bucket may be pivoted relative to the operating arm to perform various excavating operations.

Coupling assembly 18 consists of a first coupling component 27 fixedly mounted on bucket 17 and a second coupling component 28 connectable to the lower end of the operating arm. Coupling component 27 is best shown in FIGS. 3 and 4 and includes a base section 29 having an annular side surface, welded or otherwise fixedly secured to a top wall portion 30 of the bucket, and a circular plate section 31 disposed at an upper end of base section 29, providing an annular flange portion extending beyond the annular wall surface of base section 29 and spaced from upper wall portion 30 of the bucket.

Coupler component 28 includes a base section 32 adapted to be positioned on circular plate section 31 of component 27 along a diameter thereof when the coupling components are disposed in coupling relation, and a pair of connecting bracket sections 33 and 34. As best shown in FIG. 5, the upper and end surfaces of the base section are recessed as at 35 and 36, each providing a pair of opposed wall surfaces formed with inwardly opening guide slots. A pair of gripping members 37 and 38 are mounted on base section 32 within recesses 35 and 36 and are displaceable along a longitudinal centerline thereof coinciding with a diameter of circular plate section 31 when the components are disposed in coupling relation.

Gripping member 37 includes an inner section 37*a* received within recess 35, having a pair of laterally projection portions received in the guide slots in the side walls of recess 35 for guiding the member therealong, and an outer section 37*b* having a depending portion 37*c* provided with inwardly facing recess 37*d* for receiving an arcuate segment of the peripheral flange portion of plate section 31. Recess 37*d* includes a pair of upper and lower parallel surfaces spaced apart a distance slightly greater than the thickness of the annular flange portion of plate section 31, and an arcuate end wall surface 37*e* having a radius of curvature substantially the same as the radius of plate section 31. Gripping member 37 further is provided with a pair of upstanding bracket portions 37*f* and 37*g* provided with a connecting pin 37*h*. Similarly, gripping member 38 includes an inner section 38*a* received in recess 36, having a pair of laterally extending portions received in the guide slots provided in the side walls of recess 36 for guiding gripping member 38 therealong, and an outer section 38*b* having a depending portion 38*c* provided with an inwardly facing recess 38*d* adapted to receive an arcuate segment of the peripheral flange portion of plate section 31. Recess 38*d* also is provided with a pair of upper and lower parallel surfaces spaced apart a distance slightly greater than the thickness of plate section 31 and an arcuate end wall surface 38*e* having a radius of curvature similar to the radius of plate section 31. Gripping member 38 further is provided with a pair of upstanding bracket portions 38*f* and 38*g* provided with a connecting pin 38*h*. The component further is provided with a hydraulic cylinder assembly including a cylinder 39 having rod portions 40 and 41 connected to connecting pins 37*h* and 38*h* for extending and retracting the gripping members.

Connecting bracket sections 33 and 34 are provided with a first pair of rearwardly disposed, transversely aligned openings 42, 42 adapted to receive connecting pin 19 for pivotally connecting coupling component 28 to operating arm 15, and a pair of forwardly disposed, transversely aligned openings 43, 43 adapted to receive connecting pin 26 for connecting coupling component 28 to connecting links 24 and 25.

In the use of the coupling assembly as described for coupling bucket 17 to the operating arm of the machine, with coupling component 28 connected to the lower end of the operating arm with connecting pins 19 and 26 and the bucket positioned on the ground as shown in FIG. 3, controls on the machine are operated to position base section 32 of coupler component 28 on plate section 31 of coupling component 29 so that the longitudinal centerline of base section 32 is substantially aligned with a diameter of plate section 31 and coupler component 28 is disposed at a desire angle relative to coupling component 29 about an axis of plate section 31. When the components are thus positioned, further controls are operated to supply fluid under pressure to the rod ends of cylinder assembly 39 to retract the gripping members and cause segments of the peripheral flange portion of plate section 31 to be received within recesses 37*d* and 38*d*, and end wall surfaces 37*e* and 38*e* to engage the annular side wall surface of plate section 31, in gripping engagement.

Under such conditions, the coupling components will be in a coupled condition and, correspondingly, the bucket will be firmly connected to the operating arm of the machine so that the front end assembly of the machine may be operated to perform the desire digging, trenching or other functions of the bucket. During such operation, whenever there might be any slight loss of pressure in the supply lines of cylinder assembly 39 causing the gripping members to drift slightly apart out of gripping engagement with plate section 31, although coupling component 27 and attached bucket 17 might be caused to be angularly displaced relative to coupling component 27, a separation of the implement from the operating arm will be prevented by the engagement of the peripheral flange portion of section 31 with the lower surfaces of recesses 37*d* and 38*d* of the gripping members.

Whenever it may be desired to change the angle of the bucket relative to the operating arm about the axis of plate section 31, with the coupling components in the coupled condition, the controls on the machine are operated to maneuver the front end assembly of the machine to place the bucket on the ground. The controls are then operated to extend the gripping members sufficiently to retract gripping surfaces 37*e* and 38*e* of the gripping members out of gripping engagement with the annular side wall surface of plate section 31 yet insufficiently to cause the peripheral flange portion of plate section 31 to be removed from recesses 37*d* and 38*d*. With the components thus positioned, the front end assembly of the machine may be maneuvered to angularly displace the lower end of the operating arm relative to the bucket about the axis of plate section 31. When the coupling components are then properly angularly displaced, appropriate controls are operated to supply fluid under pressure to the rod ends of cylinder assembly 39 to cause the gripping members to retract into gripping relation with plate section 31. The bucket will then again be firmly connected to the operating arm at the proper orientation to proceed with the next work operation. The engagement of the peripheral flange of plate section 31 with the lower arcuate surfaces of recesses 37*d* and 38*d* again will prevent coupling component 27 and the attached bucket from separating from coupling component 28 and the operating arm.

In a modification of the embodiment shown in FIGS. 1 through 5, recesses 37*d* and 38*d* of the gripping members may be made sufficiently deep so that in lieu of recess end wall surfaces 37*c* and 38*c* engaging the circular end wall surface of plate section 31 in gripping relation, the inwardly facing, arcuately configured end surfaces of the lower, inwardly projecting lip portions of depending portions 37*c* and 38*c* will engage the annular wall surface of base section 29 in gripping relation. Such arrangement also would provide for preventing separation of the implement from the operating arm of the machine when the coupling components are in a partially uncoupled condition.

The coupling assembly shown in FIGS. 6 through 9 is similar in construction and operation to the coupling assembly described in connection with FIGS. 3 through 5 with the exception of the gripping members of the arm connected component of the assembly being operable to extend radially outwardly into gripping engagement with the implement mounted component and radially inwardly out of such engagement. The assembly generally includes a first coupling component 50 fixedly mounted on a bucket 17*a* and a second component 51 adapted to be connected to operating arm 15 by means of connecting pins 19 and 26. Coupling component 50 consists of an annular member welded or otherwise fixedly secured to an upper wall portion 30*b* of bucket 17*a*, having an inner, annular wall surface 52 provided with an annular recess 52. As best shown in FIGS. 7 and 8, annular recess 52 is provided with an upper annular wall surface 52*b* spaced from upper wall portion 30*b* and an annular end wall surface 52*c*.

Coupling component 51 includes a base section 53 and a pair of transversely spaced bracket sections 53*a* and 53*b* disposed parallel to a centerline of the base section. As best shown FIG. 9, the upper and end wall surfaces of base section 53 are recessed as at 55 and 56, each providing a pair of opposed side walls having inwardly opening, longitudinally disposed guide slots formed therein. Disposed in recesses 55 and 56 is a pair of gripping members 57 and 58 adapted to be displaced along the centerline of base section 53 into and out of gripping relation with coupling component 50. Gripping member 57 is provided with a pair laterally projecting portions received in and slidable along the guide slots of the side walls of recesse 55, and a depending section 57*a* having an outwardly projecting lip portion 57*b*. Gripping member 58 similarly is provided with laterally projecting portions received within and slidable along the guide slots formed in the side walls of recess 56, and a depending section 58*a* having an outwardly projecting lip portion 58*b*.

When coupling components 50 and 51 are disposed in coupling relation with base section 53 positioned on and disposed diametrically relative to component 50, as shown in FIGS. 7 through 9, with the gripping members retracted, gripping member sections 57*a* and 58*a* are adapted to be received within component 50, and with base member 53 thus positioned and the gripping members extended, outwardly projecting lip portions 57*b* and 58*b* will be received within annular recess 52*a* of component 50 with the arcuate outer wall surfaces thereof in gripping engagement with segments of opposed annular wall surface 52*c* of recess 52*a*. The outer wall surfaces of lip portions 57*b* and 58*b* are provided with a radius of curvature similar to the radius of inwardly facing annular wall surface 52*c* so that when base section 53 of component 51 is positioned on and disposed diametrically relative to component 50, and the gripping members are extended, the outer, arcuate wall surfaces of lip portions of 57*b* and 58*b* will firmly engage annular side wall surface 52*c* of recess 52*a* in gripping relation.

As in the previously described embodiment, gripping member 57 is provided with a pair of upstanding bracket sections 57*c* and 57*d* provided with a connecting pin 57*e*, and gripping member 58 is provided with a pair of upstanding bracket sections 58*c* and 58*d* provided with a connecting pin 58*e*. The gripping members are displaced along the centerline of component 51 by means of a hydraulic cylinder assembly 59 including a cylinder portion 60 and a pair of rod portions 61 and 62 operatively connected to connecting pins 57*e* and 58*e*, respectively. Bracket section 53*a* and 53*b* similarly are provided with a pair of rearwardly disposed, transversely aligned openings 63, 63 for receiving connecting pin 19 for pivotally connecting the rear end of the coupling assembly to operating arm 15, and a pair of forwardly disposed, transversely aligned openings 64, 64 adapted to receive connecting pin 26 for pivotally connecting the front end of the coupling assembly to connecting links 24 and 25 of the machine.

With coupling component 51 connected to the operating arm with connecting pins 19 and 26, the gripping members of component 51 in their retracted positions and bucket 17*a* positioned on the ground as shown in FIG. 6, the front end assembly of the machine may be maneuvered to position coupling member 51 on coupling component 50, with the centerline of base section 53 disposed diametrically relative to component 50 and depending sections 57*a* and 58*a* of the gripping members received within coupler component 50 with outwardly projecting portions 57*b* and 58*b* thereof disposed outwardly of recess 52*a*. The controls on the machine may then be operated further to position coupler member 51 at the desire angle relative to coupling component 50 about the axis of component 50. When the bucket is thus properly angularly positioned relative to the operating arm, further controls are may be operated to supply fluid under pressure to a center part of cylinder 60 to cause rod portions 61 and 62 to extend. The gripping members thus will be caused to extend so that lip portions 57*b* and 58*b* will be received within recess 52*a* in gripping relation with portions of annular wall surface 52*c*. The bucket will then be properly oriented and firmly attached to the operating arm to permit the operator to commence with the particular work function desired. As in the previous embodiment, in the event of any loss of fluid pressure in the cylinder causing the rod portions of the cylinder assembly to drift inwardly and retract the gripping members, separation of the implement from the operating arm of the machine will be prevented by the engagement of inwardly projecting portions 57*b* and 58*b* of the gripping members with upper annular surface 52*b* of recess 52*a*.

An adjustment of the orientation of the bucket can be accomplished similarly as in the previous embodiment by simply positioning the bucket on the ground, partially retracting the gripping members out of gripping relation with annular gripping surface 52*c* but not entirely out of recess 52*a*, maneuvering the front end assembly of the machine to repositioned coupling component 51 relative to component 50 in the desire angular relationship, and then operating cylinder assembly 59 to again extend the gripping members into gripping relation with coupling component 50. Upon completion of the particular work function and when desiring to disconnect the bucket from the operating arm of the machine, for concluding operations or desiring to connect the operating arm to a different implement equipped with a coupling component comparable to component 50, the front end of the machine is maneuvered again to place the bucket on the ground and the controls on the machine are then operated to fully withdraw the coupling members to permit the removal of portions of 57*b* and 58*b* from recess 52*a* and depending sections 57*a* and 58*a* from within component 50.

In a modification of the embodiment shown in FIG. 6 through 9, lip portions 57*b* and 58*b* of the gripping members may be formed of a greater dimension along a radius so that outwardly facing, arcuate side wall surfaces 57*e* and 58*e* of depending portion 57*a* and 58*a* will engage annular surface 52 in gripping relation.

Preferably, the coupling components as described are of a cast construction provided with a minimal amount of machining to reduce costs. Such components, however, may be of a fabricated construction or a combination of a fabricated and cast construction. It further is contemplated that such components be formed of steel of suitable strength.

From the foregoing detailed description, it will be evident that there are a number of changes, adaptations and modifications of the present invention which come within the province of those persons having ordinary skill in the art to which the aforementioned invention pertains. However, it is intended that all such variations not departing rom the spirit of the invention be considered as within the scope thereof as limited solely by the appended claims.

We claim:

1. An assembly for coupling an implement to an operating arm of a machine comprising:

a first component including a base section fixedly mountable on a wall portion of said implement, having an annular flange section disposed on an upper end of said base section; and a second component connectable to said operating arm, including a base section disposable in coupling relation with said first component, a pair of gripping members disposed on said base section and displaceable into and out of gripping engagement with said annular flange section of said first component when said components are disposed in said coupling relation, and means for selectively displacing said gripping members into and out of gripping engagement with said annular flange section of said first component, each of said gripping members having a recess for receiving a segment of said annular flange section therein, having an end wall surface engageable with a segment of an annular end wall surface of said annular flange section, in gripping engagement, and upper and lower opposed wall surfaces for receiving said segment of said annular flange section therebetween; and wherein said annular flange section projects inwardly and said gripping members are extendable outwardly into gripping relation with said annular flange section; and wherein said displacing means comprises a fluid actuated means.

2. An assembly according to claim 1 wherein said gripping members are displacable along a diametrically disposed line of travel when said components are disposed in coupling relation.

3. An assembly according to claim 1 wherein said end wall surface of each of said recesses in each of said gripping members is arcuately configured.

4. An assembly according to claim 1 wherein said upper and lower wall surfaces of each of said recesses are spaced a slightly greater distance than the thickness of said annular flange section to permit said second component to be angularly displaced relative to said first component about the axis of said annular flange section while preventing unrestricted displacement of said second component relative to said first component along a line of travel coinciding with said axis when said gripping members are retracted out of gripping engagement but not fully retracted clear of said recess.

5. An assembly for coupling an implement to an operating arm of a machine comprising:

a first component including a base section fixedly mountable on a wall portion of said implement, having an annular flange section disposed on an upper end of said base section; and a second component connectable to said operating arm, including a base section disposable in coupling relation with said first component, a pair of gripping members disposed on said base section and displaceable into and out of gripping engagement with said annular flange section of said first component when said components are disposed in said coupling relation, and means for selectively displacing said gripping members into and out of gripping engagement with said annular flange section of said first component, each of said gripping members having a recess for receiving a segment of said annular flange section therein, having an end wall surface engageable with a segment of an annular end wall surface of said annular flange section, in gripping engagement, and upper and lower opposed wall surfaces for receiving said segment of said annular flange section therebetween; and wherein said annular flange section projects inwardly and said gripping members are extendable outwardly into gripping relation with said annular flange section; and wherein said upper and lower opposed wall surfaces of each of said recesses in each of said gripping members are parallel and spaced apart a slightly greater distance than the thickness of said annular flange section to permit said second component to angularly displace relative to said first component about the axis of said annular flange section while preventing unrestricted displacement of said second component relative to said first component along a line of travel coinciding with said axis when said gripping members are retracted out of gripping engagement but not fully retracted clear of said recess.

6. An assembly according to claim 5 wherein said displacing means comprises a fluid actuated means.

7. An assembly according to claim 5 wherein said end wall surface of each of said recesses in each of said gripping members is arcuately configured.

* * * * *